US005093650A

United States Patent [19]

Kolbatz

[11] Patent Number: 5,093,650

[45] Date of Patent: Mar. 3, 1992

[54] PORTABLE ALARM DEVICE

[76] Inventor: Klaus-Peter Kolbatz, Langenauer Weg 21, 1000 Berlin 27, Fed. Rep. of Germany

[21] Appl. No.: 544,542

[22] Filed: Jun. 28, 1990

Related U.S. Application Data

[63] Continuation-in-part of Ser. No. 372,450, Jun. 28, 1989, abandoned.

[30] Foreign Application Priority Data

Aug. 17, 1988 [DE] Fed. Rep. of Germany ..... 3828296

[51] Int. Cl.[5] ..... G08B 19/00; G08B 13/08

[52] U.S. Cl. ..... 340/521; 340/541; 340/546; 340/565; 340/554; 340/636; 340/693

[58] Field of Search ..... 340/521, 566, 565, 546, 340/547, 541, 693, 573, 554, 539, 636, 568, 524; 200/61.05, 61.93

[56] References Cited

U.S. PATENT DOCUMENTS

| | | | |
|---|---|---|---|
| 2,935,582 | 5/1960 | Northey | 340/566 |
| 3,680,074 | 7/1972 | Lieser | 340/554 |
| 4,110,945 | 9/1978 | Sheahan | 200/61.05 |
| 4,225,858 | 9/1980 | Cole et al. | 340/554 |
| 4,310,835 | 1/1982 | Sefton | 340/524 |
| 4,319,228 | 3/1982 | Daniels | 340/546 |
| 4,581,606 | 4/1986 | Mallory | 340/539 |
| 4,678,998 | 7/1987 | Muramatsu | 340/636 |
| 4,742,336 | 5/1988 | Hall et al. | 340/539 |
| 4,746,906 | 5/1988 | Lederer | 340/565 |
| 4,772,875 | 9/1988 | Maddox et al. | 340/565 |
| 4,943,799 | 7/1990 | Papineau | 340/693 |

OTHER PUBLICATIONS

Mountain West, catalog A-80, p. 6, Phoenix, Az., 1979, Mountain West Alarm Supply Co.

*Primary Examiner*—Donnie L. Crosland
*Attorney, Agent, or Firm*—Millen, White & Zelano

[57] ABSTRACT

A portable alarm device for monitoring areas against burglary includes an alarm and a power supply connected to the alarm by an alarm circuit. A reception sensor is connected to a variable preamplifier for varying volumes of the alarm signal in accordance with the size of the area being monitored. The preamplifier is connected to at least one rejector circuit frequency filter for controlling the susceptible frequency range of the alarm trigger signals with a microprocessor connected to the rejector frequency filter to receive and transmit the signal. A signal converter is used to activate the power supply. A push button time switch is connected to the signal converter in order to delay time or readiness of the alarm for operation and the power supply is connected to the alarm through the signal converter by a closed circuit for delivering a constant low-intensity current with intermittent interruption by the signal converter.

3 Claims, 2 Drawing Sheets

PORTABLE ALARM DEVICE

This is a continuation-in-part of application Ser. No. 07/372 450, filed 6-28-89, now abandoned.

BACKGROUND OF THE INVENTION

The invention relates to the area of theft and burglar alarm systems which are portable and can be readily taken from place to place.

Portable alarm devices are known as indicated, for example, in the following discussion of the prior art. The known portable alarm systems, however, do not operate completely satisfactorily, because they are not suitable for monitoring all areas requiring protection. Others require additional wiring and can be adapted to all conditions only with difficulty.

The object of the invention, therefore, is to provide an independent portable alarm device which can readily be moved from place to place and put into use.

This object includes the possibility of enabling the device simply to be put down and switched on without any wiring or tedious installation, whether in motor vehicles, caravans, summer houses or multi-storey dwellings.

Other advantages of the invention will be apparent from the following description.

PRIOR ART

The applicant is well aware of U.S. Pat. No. 4,742,336 (Hall), which shows a portable alarm device requiring a set of wiring over which the alarm-triggering signal reach the actual alarm device.

The same applies to the alarm device according to U.S. Pat. No. 4,319,228 (Daniels). Here, complex installation using sensors is required for the objects being monitored. An independent alarm system is impossible, since complex wiring is required.

DETAILED DESCRIPTION

Figure 1:
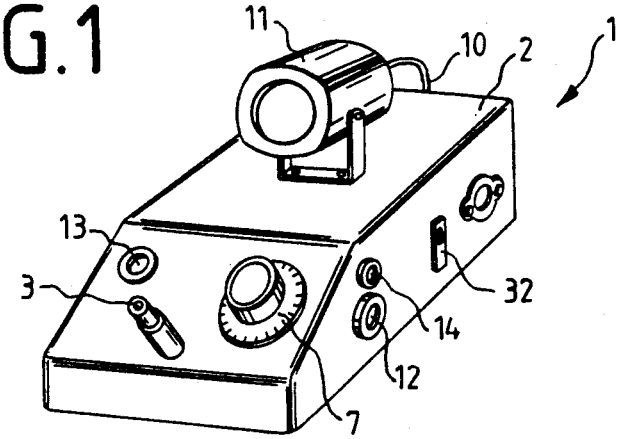
FIG. 1 is a perspective view of the alarm device according to the invention.

FIG. 1 shows the alarm system according to the invention. The alarm device 1 consists essentially of a housing 2 containing all the electronics for the input and output of the alarm signals so that the alarm device is completely independent and cable connections are fundamentally unnecessary.

Figure 2:
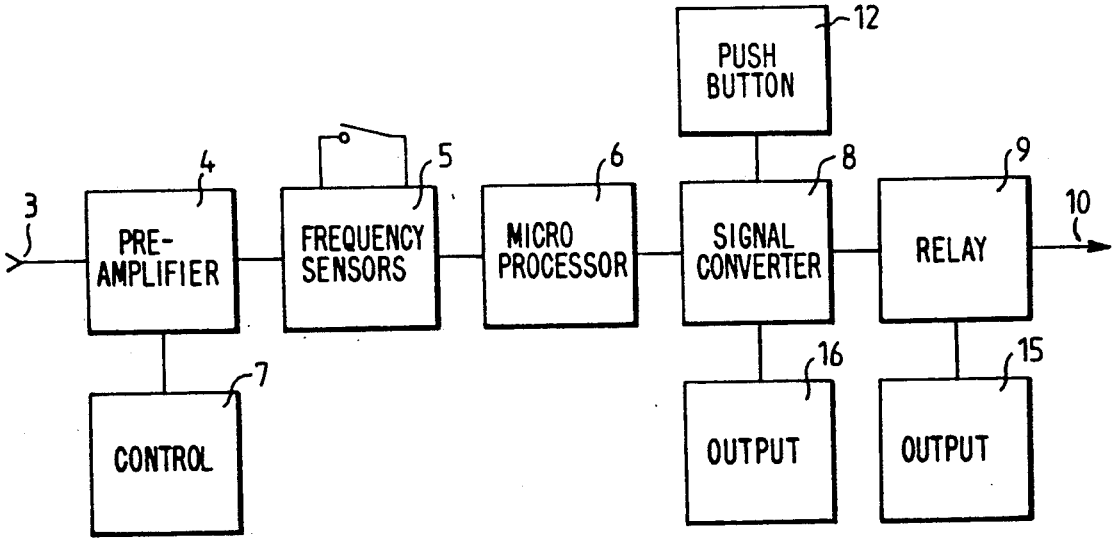
FIG. 2 is a schematic diagram of the electronic circuit used in this alarm device.

FIG. 2 shows the electronic circuit disposed inside the housing 2.

The reception sensor 3 is disposed at the entry side of the housing 2 and from this sensor the normal noise level from outside and any sudden variations in the normal noise level or in the normal air pressure are fed via a pre-amplifier 4 to one or more rejector circuit frequency sensors 5. In the latter the incoming frequencies are filtered into the associated required range so that only the frequencies due to the sudden variations and intended for the alarm are passed to a connected microprocessor 6. Since any material when broken generates a different frequency it is possible in this way controllably to transmit the alarm signals, e.g. for the breakage of glass in the event of windows being broken or for the breakage of wood if doors are broken open, irrespective of the normal environmental, noise.

In this way it is possible, using just one of these alarm devices, to monitor not only motor vehicles and caravans, but also summer houses and larger dwelling units, because the sudden air pressure variations occurring on the breakage of a door or window reach the frequency filter 5, which passes only frequencies in the specific lower range, more particularly below 30 Hz, to the microprocessor 6.

A control 7 integrated in the pre-amplifier 4 and operable from the outside of the housing 2 controls the amplification factor of the alarm signals controllably and individually for each area size.

A chargeable power supply 17, e.g. an accumulator, is also accommodated in the housing 2 and supplies the electronic circuits with a low-intensity closed-circuit current which, in the event of an alarm, is interrupted to give the alarm. An indicator (not shown) conventionally displays the charging state of the accumulator 17, which can be duly charged via one of the known connecting sockets, the same also serving for the connection of an external power supply via a suitable transformer. The alarm device 1 of course also has a switch for switching the alarm facility on and off.

The frequencies at the microprocessor 6 have a harmonic a.c. character. These frequencies are usually not passed. In the event of an alarm, the frequencies fed to the microprocessor have steep flanks which are passed in the form of rectangular signals to a signal converter 8 consisting of two transistors with a flip-flop circuit, so that a relay 9 is pulled up and feeds the alarm signal to the output 10, where it triggers an acoustic signal in a signal horn 11 disposed on the housing 2. The duration of this condition depends on the holding voltage built up in the R-C network in the transistor circuit 8. Instead of an acoustic alarm it is possible to trigger an optical alarm or both.

By means of an electronic time switch 12 it is possible to input a time whereby the device can be switched off for a few minutes in response to actuation of a push button in order to allow unobstructed departure from or entry to a house, apartment, motor vehicle, caravan or the like, where the alarm device 1, which is readily transportable because of its compactness and independence of any wiring, can readily be accommodated and even concealed on a shelf or in a drawer. A pilot light 13 indicates whether the alarm device is switched on and a pilot light 14 indicates whether the ready state of the alarm has been temporarily interrupted by the time switch 12.

Figure 3:
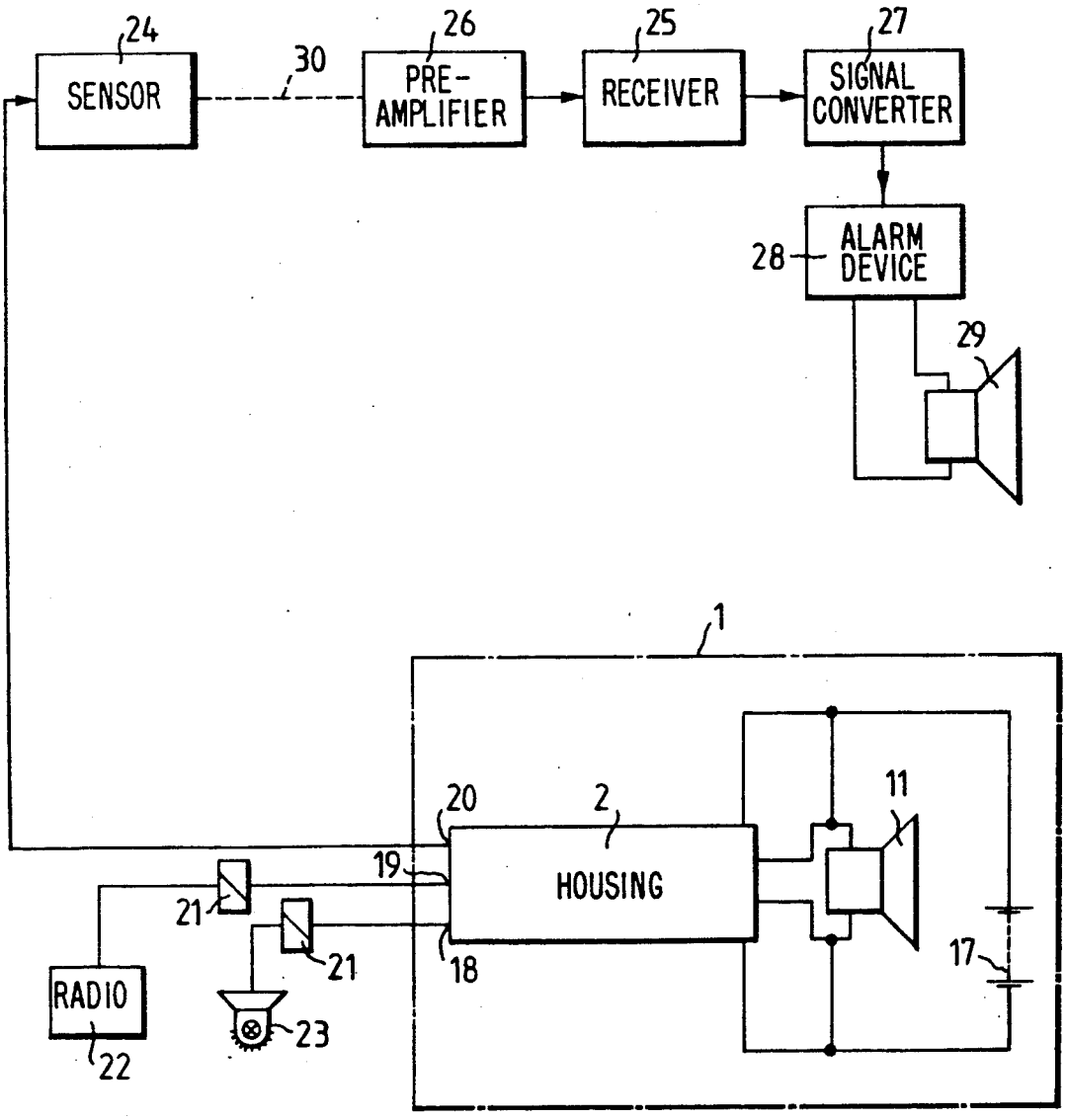
FIG. 3 is a block schematic for additional detectors which can be connected by means of the invention.

FIG. 3 illustrates proposals for additional versatile alarm facilities by means of the invention. This purpose is served by another output 15 on the relay 9, which can co-operate with additional optical and acoustic signals or radio transmitters, and another output 18 on the signal converter 8 which serves to monitor the gas and water supply and shut off any damage to pipes. An infra-red movement detector can also be connected in this way to detect any unnoticed approach to a house or car park. The same applies to closure contacts for protecting drawers, cash boxes or gaming machines.

The monitoring of swimming pools can also be coupled to the alarm device 1. The arrangement described in applicant's U.S. Pat. No. 4,853,691 for acoustic alarms in the event of a person falling into a swimming pool is suitable for this purpose.

In the block schematic diagram shown in FIG. 3, additional connecting sockets are indicated on the housing 2 and serve as outputs 18, 19 and 20 for the connection of additional acoustic or optical alarm means, without departing from the principle of the invention. Thus switching relays 21 could be disposed between the outputs 18 and 19 to co-operate with a radio 22 or a motor vehicle horn or a revolving light 23.

A sensor 24 could be connected to the output 20 and transmit alarm signals via an air gap 30 to a remote receiver 25, a pre-amplifier 26 providing the necessary amplification. Another alarm device 28 with an acoustic alarm 29 is connected to the receiver 25 via a signal converter 27.

It will be apparent from the foregoing that the alarm device according to the invention which, because of its compactness, can be readily used anywhere without any special installation, is suitable for use for any problems in the area of giving an alarm without it being necessary to alter the alarm device itself.

While I have shown and described an embodiment of this invention in some detail, it will be understood that this description and illustrations are offered merely by way of example, and that the invention is to be limited in scope only by the appended claims.

I claim:

1. A portable alarm device for monitoring areas against burglary, comprising a housing having an input (3) for the reception and an output (10) for the delivery of alarm-triggering signals which are processed between the input and output, a power supply (17) disposed in the housing, and an alarm (11) disposed on the housing, the alarm circuit including a reception sensor (3) on the input side of the housing (2) to receive the incoming signals: a variable preamplifier (4) connected to the reception sensor (3) for varying the volume of the alarm according to the size of the area being monitored; the preamplifier being connected to:

a) at least one rejector circuit frequency filter (5) for controlling the accessible frequency range of the alarm-triggering signals;

b) a microprocessor (6) connected to the rejector frequency filter (5) to receive and transmit the said signals; a signal converter (8) consisting of a flip-flop circuit connected to the power supply (17) for activating the power supply (17);

c) a relay (9) connected to the alarm (11) by the output (10) for transmitting the signals to the output (10) in order to sound the alarm (11);

d) a time switch in the form of a pushbutton switch (12) connected to the signal converter (8) in order to delay the time or readiness of the alarm device for operation;

e) a closed circuit connecting the power supply (17) to the alarm (11) through the signal converter (8) for delivering a constant low-intensity current with intermittent interruption by the signal converter (8).

2. An alarm device according to claim 1, wherein a plurality of additional connection sockets (15 and 16) are provided on the housing (2) for the connection of loose cables adapted to be connected to the alarm device, such cables being designed for the connection of a water detector, a gas detector, a fire detector, and an infra-red movement detector.

3. An alarm device according to claim 2, wherein a transmitter (24) is provided which is adapted to be connected via the connecting socket (20) to circuitry in the housing, the transmitter being connected to a receiver (25) and another alarm device (28).

* * * * *